United States Patent [19]

Wolfe

[11] Patent Number: 4,718,661

[45] Date of Patent: Jan. 12, 1988

[54] APPARATUS FOR PLAYING A GAME IN WATER AND SEPARABLE AND RE-ATTACHABLE TAIL MEMBER

[76] Inventor: Henry S. Wolfe, 14810 Rue De Bayonne, Apt. 3 H, Clearwater, Fla. 33520

[21] Appl. No.: 723,454

[22] Filed: Apr. 15, 1985

[51] Int. Cl.[4] ..... A63G 19/00; A63B 7/00

[52] U.S. Cl. ..... 272/1 B; 273/1 GG

[58] Field of Search ..... 272/1 B, 1 D, 1 R, 24, 272/52, 52.5, 53.1, 53.2, 85, 86, 87, 88, 89, 90, 91, 92, 16, 17, 18, 50, 6, 8 R, 8 N, 8 D, 109, 93, 111, 142, 144, 71; 273/1 G, 1 GG; 434/258, 255, 247; 441/129, 130, 131, 132

[56] References Cited

U.S. PATENT DOCUMENTS

| | | | |
|---|---|---|---|
| 1,718,637 | 6/1929 | De Pento | 272/1 B |
| 2,404,729 | 7/1946 | Hurt | 272/1 B |
| 2,651,880 | 9/1953 | Kennedy | 272/1 D X |
| 2,707,102 | 4/1955 | Wendt | 272/1 D |
| 2,721,080 | 10/1955 | Wischer | 272/1 D X |
| 2,846,224 | 8/1958 | Roselle | 273/55 C |
| 3,063,718 | 11/1962 | Steinkamp | 273/DIG. 30 X |
| 3,499,647 | 3/1970 | Nestler | 272/1 B |
| 3,579,745 | 5/1971 | Wilson | 273/55 C X |
| 3,592,468 | 7/1971 | Simendinger, Jr. | 272/1 B X |
| 4,222,558 | 9/1980 | Tingliely et al. | 272/31 A |
| 4,551,108 | 11/1985 | Bass | 272/1 B X |

FOREIGN PATENT DOCUMENTS

| | | | |
|---|---|---|---|
| 16542 | of 1906 | United Kingdom | 272/52 |
| 385351 | 2/1932 | United Kingdom | 272/1 B |

*Primary Examiner*—Richard T. Stouffer

*Attorney, Agent, or Firm*—Ronald E. Smith

[57] ABSTRACT

Apparatus for playing a plurality of games and methods for playing the games. In a first game, a rider straddles an inflatable toy animal in the form of a bull. A plurality of ring members are fixedly secured to opposite sides of the bull, fore and aft thereof, and rope members are tied to the different rings. The free ends of the ropes are tugged by additional players of the game who are positioned outside the pool, in an attempt to unseat the rider. In another game, a second inflatable toy in the form of a horse is straddled by a second rider. The second rider tugs on a rope or ropes attached to the ring or rings of the bull in an attempt to capture the bull or unseat its rider. Another game includes an inflatable animal with a removeable tail and the object of the game is for the rider of another inflatable toy to chase the tailed toy animal and to remove the tail therefrom.

4 Claims, 7 Drawing Figures

APPARATUS FOR PLAYING A GAME IN WATER AND SEPARABLE AND RE-ATTACHABLE TAIL MEMBER

BACKGROUND OF THE INVENTION

1. Field of the Invention

This invention relates, generally, to methods of playing games in swimming pools or other bodies of water and apparatus for use in playing such games.

2. Description of Prior Art

Several devices have been developed over the years that have utility as swimming pool toys. For example, in 1935, U.S. Pat. No. 2,013,410 was awarded to Howland for an inflatable horse suitable for straddling by a rider. Another U.S. Pat. No. 2,404,729, was issued in 1944 to Hurt for a similar device. Neither the Howland nor the Hurt devices provided handle members to which the riders of the inflatable toys could hold.

A patent showing the use of hand holds was awarded to Wilkins in 1961 (U.S. Pat. No. 2,997,299), and an inflatable toy having a seat belt was patented in 1963 by Williams (U.S. Pat. No. 3,102,280). U.S. Pat. No. 4,336,931 shows an inflatable toy having bulbous upraised ends and a concavity therebetween upon which a rider sits.

The art of rideable pool toys does not include the combination of inflatable toys having mounting means to which may be attached rope members the free ends of which may be grasped and tugged by non-riders in an attempt to unseat a rider. Nor does the art teach games playable by two (2) or more riders where one rider tugs a rope attached to another rider's mount in an attempt to unseat the latter. Nor does the art suggest pursuit games where one rider on an inflatable, tailed mount is pursued by another rider on another inflatable mount who attempts to maneuver into a position to remove the tail.

SUMMARY OF THE INVENTION

The swimming pool games of this invention require the provision of buoyant but stable inflatable toy animals which may be straddled by individuals and ridden upon. The animals may be maneuvered in any direction by their respective riders by hand paddling, kicking, bouncing or any combination thereof.

One of the game apparatus, a toy bull, is provided with ring members to which ropes may be tied. The bull and the other inflatable toys are provided with handle members which may be grasped by the rider thereof. In games where the object of the game is to unseat a rider from a toy by pulling on one or more ropes secured to one or more rings, the rider may or may not choose to grasp the handles. Instead, the rider may elect to squeeze the toy between his or her knees and use his or her hands to paddle with, splash the other players, and the like. The rules that govern play of the novel games do not contemplate grasping of the ropes by the rider of the toy to which the ropes are tied, however.

A removeable tail is provided in a toy animal used in a game where the object is to pursue the tailed animal on another flotable mount and to remove the tail upon coming into close proximity to the pursued toy animal. The removeable tail is fixedly secured to a split ring which interlocks with the unsplit or continuous ring formed on the tail end of the toy so that tugging of the tail separates the split ring from the unsplit ring.

It is an object of this invention to advance the art of water games by providing new devices for use in such games and by providing methods for using such new devices.

A more specific object is to provide pool games employing ropes so that a player riding an inflatable toy on a body of water can be given a "bronco" ride as ropes attached to his mount are tugged by individuals who are not in the body of water.

Another specific object is to provide pool games playable by two or more players on flotable mounts where one player may attempt to unseat the other player by pulling on a rope or ropes attached to the other player's mount.

Still another specific object is to provide a pursuit game where the pursuing player attempts to partialy disassemble a pursued toy animal.

The invention accordingly comprises the features of construction, combination of elements and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

Similar reference numerals refer to similar parts throughout the several views of the drawings.

DETAILED DESCRIPTION OF THE PREFERRED EMBODIMENT

Figure 1:
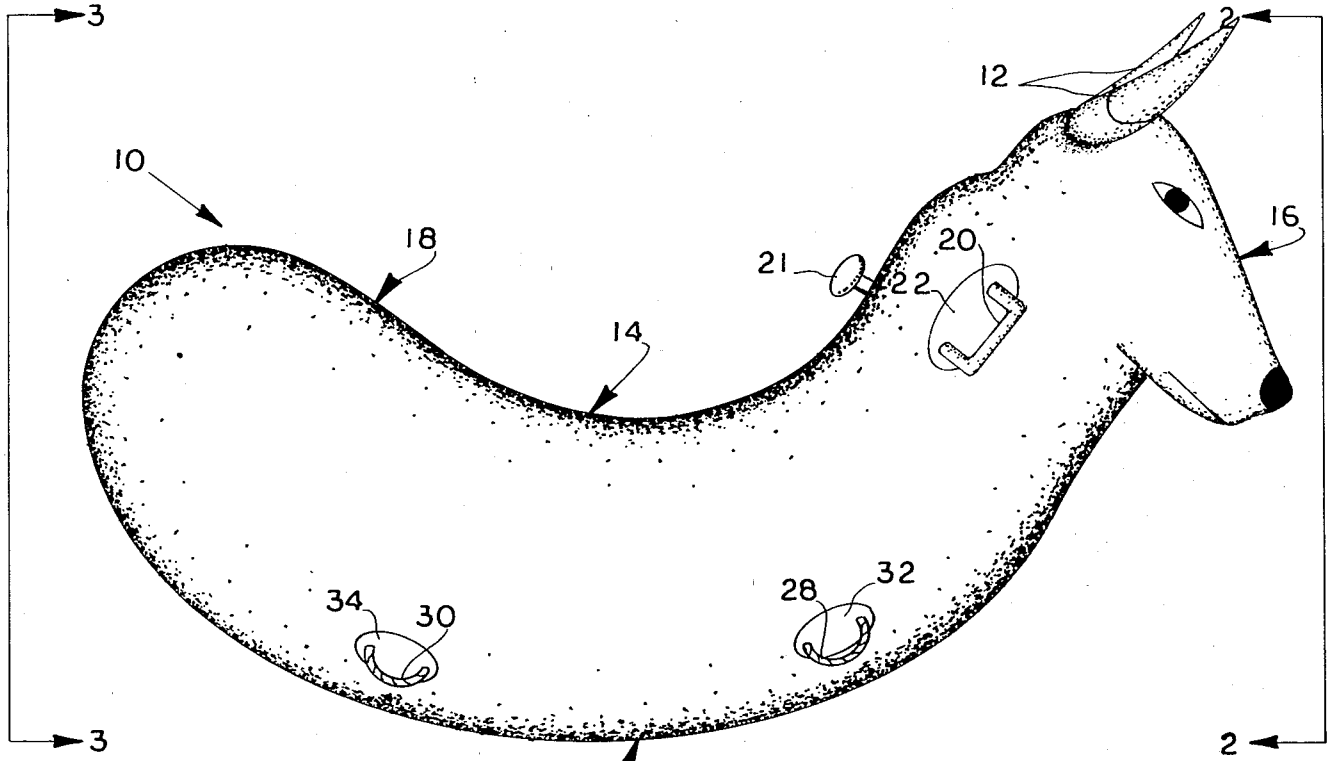
FIG. 1 is a side elevational view of an inflatable toy bull.

Referring now to FIG. 1, it will there be seen that an inflatable toy constructed in accordance with the teachings of this invention is designed by the reference numeral 10 as a whole.

The toy 10 is in the form of an inflatable bull having horns 12. An acruate surface 14 is flanked fore and aft by upraised head and tail portions 16, 18, respectively. This design is known to provide a reasonably stable mount for an individual straddling the arcuate surface 14.

A pair of hand holds are fixedly secured to the neck region of the toy, on opposite sides thereof. Only one (1) of the two (2) hand holds is visible in FIG. 1 and is designated 20. The hand hold 20 is secured to pad 22 which in turn is secured to the toy by suitable means. Its counterpart on the opposite side of the toy's neck is marked 24 in FIG. 2.

It is also within the contemplation of this invention to provide a single hand hold 21 in the form of a knob as depicted in FIG. 1. The single hand hold 21 could also be provided in the form of handles 20, 24. Knob 21 is positioned coincident with the longitudinal axis of symmetry of toy 10 and thus is similar to a saddle horn of the type grasped one-handedly by rodeo riders in rodeo events. Knob 21 can be provided in lieu of handles 20, 24, or in combination therewith.

Four (4) ring members are similarly secured to the fore and aft portions of the body of the toy, adjacent the bottom 26 thereof. Specifically, rings 28 and 30 are secured to pads 32 and 34, respectively, which are secured to the toy as illustrated. Another pair of fore and aft rings are provided on the opposite side of the toy 10, and are marked in FIG. 2 by the reference numerals 36, 38, respectively. It is also within the contemplation of this invention to position the rings higher on the body of the toy so that they would be above the water line.

Figure 3:
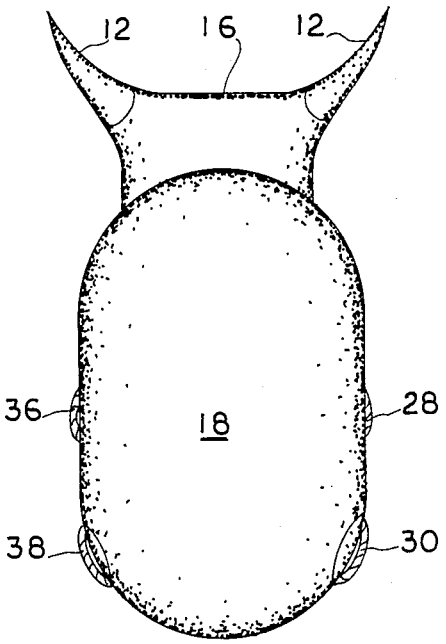
FIG. 3 is a rear elevational view of the bull taken along line 3—3 of FIG. 1.

The same rings are shown in FIG. 3.

Figure 4:
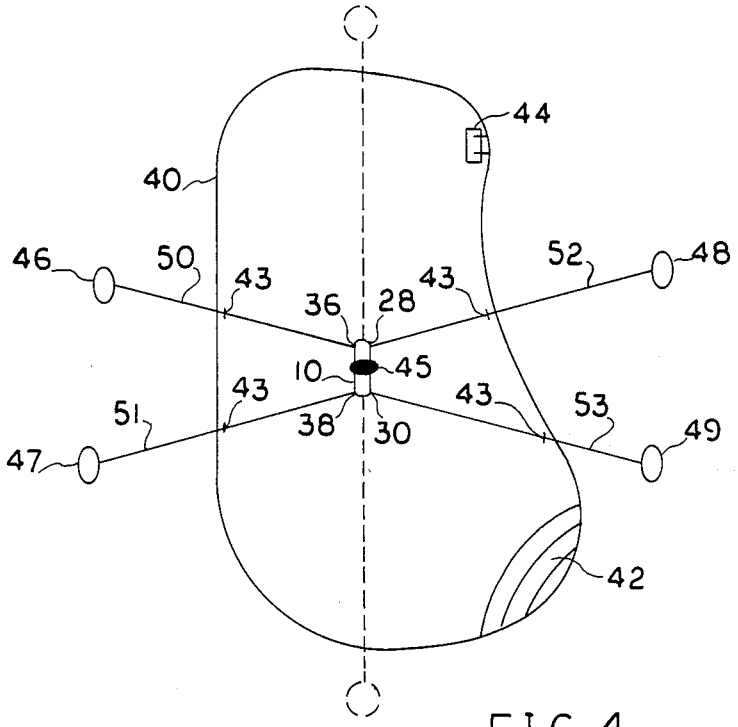
FIG. 4 is a top plan view of a pool diagrammatically showing five (5) players of a game that uses the bull of FIGS. 1–3.

Reference should now be made to FIG. 4 wherein the bull 10 is shown in the middle of a pool 40 having steps 42 and ladder 44. In the game played with bull 10, five (5) players may participate. The player riding bull 10 is designated 45, and the other four (4) players are designated 46, 47, 48 and 49. When the game is played, player 46 tugs the free end of rope 50, the secured end of which is attached to fore ring member 36. Player 47 tugs rope 51, and players 48 and 49 tug ropes 52 and 53, respectively. In this manner, rider 45 of bull 10 enjoys the sensation of riding a "bucking bronco" while players 46–49 enjoy trying to unseat such rider from bull 10. The game must be played with the bull 10 near the middle of the pool as depicted. The game begins when the rider is comfortably seated on his or her mount and indicates to the other players that he or she is ready to test his or her riding skills.

The ropes which are used in the novel games described herein are provided with a red band 43 or similar marking about eight feet (8′) from their respective free ends. No rope may be pulled upon if the red band extends beyond the border of the pool. This safety feature ensures that the rider of the mount which is being shaken or otherwise displaced by the other game players will always be at least eight feet (8′) from the pool edge. Moreover, where a rope puller is positioned in the pool water, the red band denotes the distance which the puller must keep away from the rider. The position of the red bands 43 is shown and should be noted in both FIGS. 4 and 6.

Additional rope mounting ring members could be provided to the head and tail portions of the bull 10, and additional ropes could be secured thereto and tugged upon by additional players, as suggested in phantom lines in FIG. 4. Clearly, in view of the teachings of this invention, a higher (or lesser) number of ropes and rope mounting means could be employed.

In all of the games, safety considerations would require that ropes not in use should be disconnected from the buoyant toys and removed from the pool so that no one may become entangled by free floating ropes.

Figure 5:
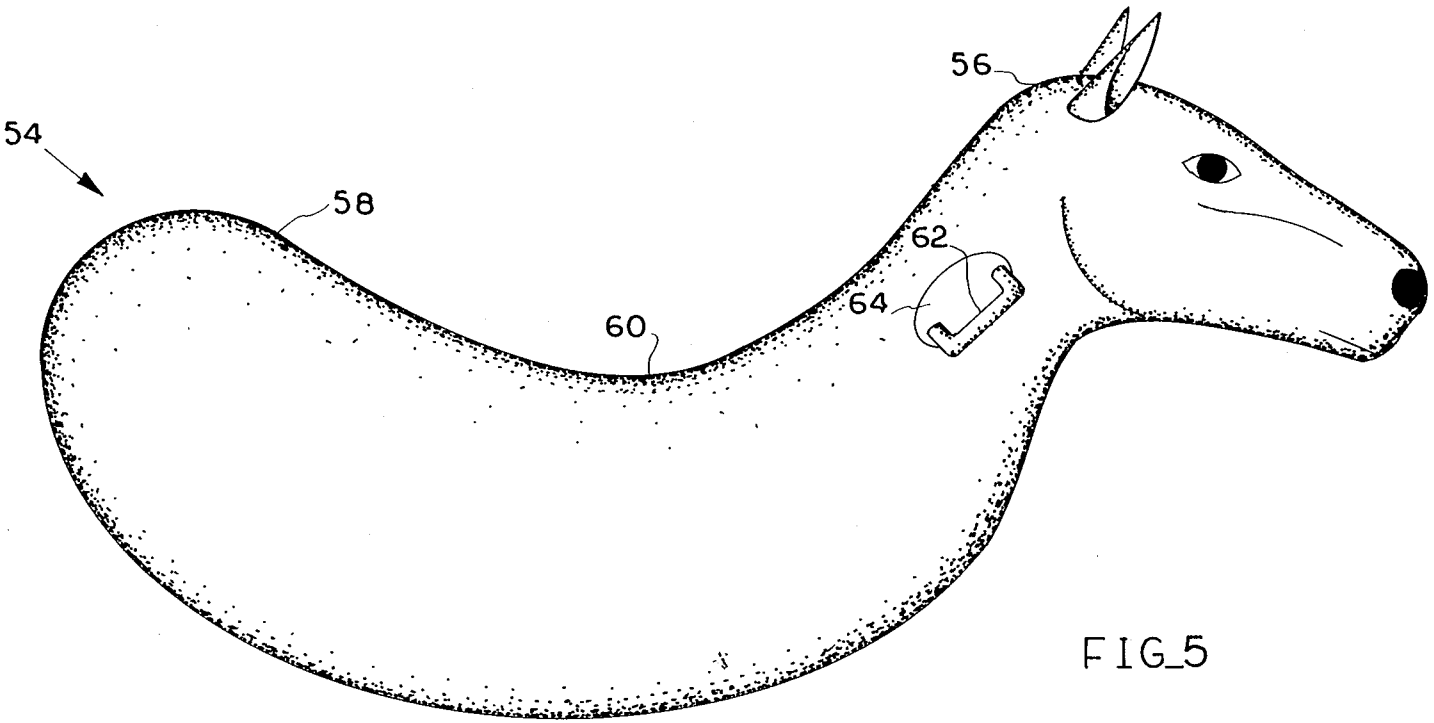
FIG. 5 is a side elevational view of an inflatable toy horse.

An inflatable toy horse 54 is depicted in FIG. 5. It includes elevated fore and aft portions 56, 58 and concavity 60 upon which the rider of the toy sits. Hand hold 62 is fixedly secured to pad 64, and each of said parts have a counterpart on the opposite side of the toy's head. As shown, the horse 54 is not provided with the ring members 28, 30, 36, 38 of bull 10, but such ring members could be provided if it were desired to produce a bucking bronco type of horse toy. Moreover, the saddle horn 21 of the bull could be provided as a part of the horse 54 as well.

Figure 2:
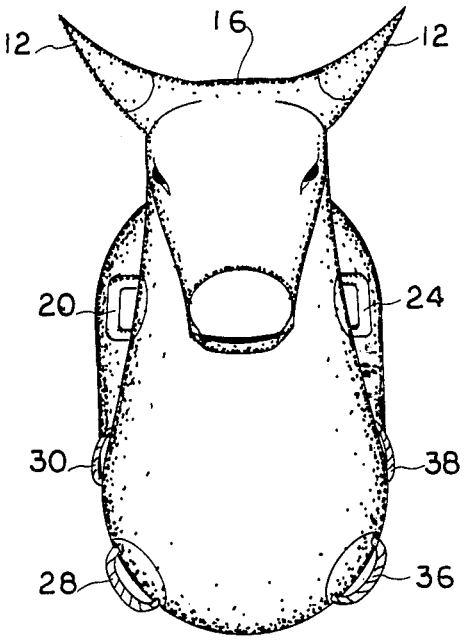
FIG. 2 is a front elevational view of the bull taken along line 2—2 of FIG. 1.
Figure 6:
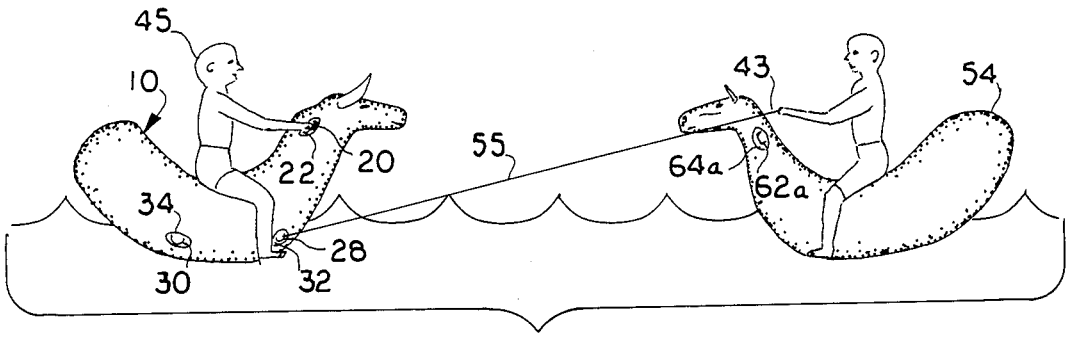
FIG. 6 is a side elevational view of a game played with the bull of FIGS. 1–3 and the horse of FIG. 5.

The horse 54 of FIG. 5 and the bull 10 of FIGS. 1–3 are used, in a second game, as depicted in FIG. 6. Rope 55 is tugged upon by player riding horse 54 in an attempt to capture bull 10 or to unseat its rider. The distal end of rope 55 is tied to fore ring 28 of bull 10, in this particular example. Rider 45 of bull 10 may attempt to escape capture by paddling with his or her hands, kicking, and similar movements. Play begins when the rider of the bull advises the rider of the horse that he or she is ready to begin testing his or her riding skills.

Figure 7:
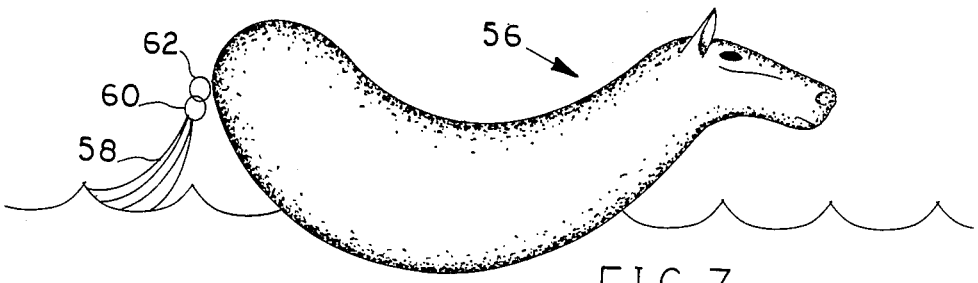
FIG. 7 is a side elevational view of a horse having a removeable tail.

Still another apparatus is shown in FIG. 7. It includes horse 56 having a tail 58 which is fixedly secured to a split ring member 60. The split ring 60 interlocks with a continuous or un-split ring 62 which is fixedly secured to the aft portion of the horse 56 as shown. In the game played with horse 56, players riding mounts such as bull 10 or horse 54 attempt to maneuver their toys near the tail 58 so that it may be grasped and separated from solid ring 62. The player riding tailed horse 56 may spin his or her mount in circles in an attempt to prevent the capture of the tail 58, may try to prevent capture by paddling away from the pursuing players, or any combination of such maneuvers. Play begins when the rider of the pursued mount initiates the play.

The tail is preferably of nylon strand material of the type from which are made fishing lures. Polypropylene would be a suitable material, for example. Both the split ring and the solid ring should be made of a soft vinyl material, for safety purposes, as the use of hard materials such as hard vinyl or metal is contraindicated.

As another safety consideration, tail 58 is preferably about three feet (3′) in length. Thus, it floats upon the water and trails the horse as shown in FIG. 7. Thus, the pursuing rider need get no closer than about three feet (3′) to the pursued rider in order to successfully grab tail 58.

The toy bull and horses shown and described herein were hertofore unknown. More importantly, however, are the methods of playing games which may be enjoyed due to the provision of such new swimming pool toys. Many children are fond of "bucking broncos" and other rodeo-related events, but have no access to real horses and in most cases are not trained to handle even tame horses, much less untamed horses or bulls. Nor are mechanical bulls generally available to the younger set. The games disclosed herein provide the fun of rodeo events without the danger of falls onto hard surfaces, and enhance the fun by enabling the same to be played in swimming pools or other bodies of water. This combines two (2) of the favorite activities of adults and children as well, and therefore provides unprecedented entertainment.

Safety considerations dictate that the ropes which are employed in some of the games be removed from the pool whenever they are not in use. This safety precaution would preclude entanglements which could otherwise occur.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described, That which is claimed is:

1. A game apparatus for playing a game in a body of water, comprising, a first buoyant mount of a size and shape to be straddled and operated by a first rider, said first mount being sufficiently buoyant to completely buoyantly support said first rider in water, said first mount having a tail member detachably secured to its aft end which end is behind the rider of said first mount when said rider faces in the direction of travel of said first mount, a second buoyant mount adapted to be straddled and operated by a second rider, said second mount being sufficiently buoyant to completely buoyantly to support said second rider in water, said tail member being detachably secured to said first mount by means with portions separable from each other by a tugging force thereon by said second rider, said separable means also being means for re-attaching said detachably secured tail member to said first mount after detachment of said tail member from said first mount, said separable and re-attaching means operating to secure and to re-attach said tail member to said first mount independently of any other structure and structured to facilitate both separation of the portions of the separable means and re-attachment of the same to said first mount, whereby said second rider may pursue said first rider in an attempt to remove said tail member.

2. The game apparatus of claim 1, wherein said separable and re-attaching includes a split ring member of annular configuration to which said tail member is fixedly secured, a continuous ring member of annular configuration fixedly secured to said first buoyant mount at said aft end thereof, and said split and continuous, respectively, annular ring members being initially disposed in interlocking relation to one another and being separable but re-attachable attendant pulling of said tail member by said second rider when in pursuit.

3. The game apparatus of claim 1, wherein said tail member is formed of a buoyant material so that it floats and thus facilitates its being grasped by said second rider when in pursuit.

4. The game apparatus of claim 3, wherein the length of the tail member is about three feet to facilitate the first and second riders being spaced safely apart from one another even when said second rider grasps said tail member.

* * * * *